US011031732B2

(12) United States Patent
Shimizu et al.

(10) Patent No.: US 11,031,732 B2
(45) Date of Patent: Jun. 8, 2021

(54) LEVER-TYPE CONNECTOR

(71) Applicant: YAZAKI CORPORATION, Tokyo (JP)

(72) Inventors: Tomohiko Shimizu, Makinohara (JP); Shogo Suzuki, Makinohara (JP); Hidenori Kanda, Makinohara (JP); Masayuki Saito, Makinohara (JP); Takuya Hasegawa, Fujieda (JP); Kazuya Terao, Fujieda (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/696,408

(22) Filed: Sep. 6, 2017

(65) Prior Publication Data

US 2018/0069347 A1 Mar. 8, 2018

(30) Foreign Application Priority Data

Sep. 7, 2016 (JP) ..... JP2016-174968

(51) Int. Cl.
*H01R 13/639* (2006.01)
*H01R 13/629* (2006.01)
(Continued)

(52) U.S. Cl.
CPC ..... *H01R 13/639* (2013.01); *H01R 13/502* (2013.01); *H01R 13/62938* (2013.01); *H01R 13/62955* (2013.01); *H01R 2107/00* (2013.01)

(58) Field of Classification Search
CPC ..... H01R 13/62955; H01R 13/639; H01R 13/502; H01R 13/506; H01R 13/62938
(Continued)

(56) References Cited

U.S. PATENT DOCUMENTS 5,609,494 A * 3/1997 Yamaguchi ..... H01R 13/62933 439/157
6,012,933 A * 1/2000 Katsuma ..... H01R 13/62933 439/157
(Continued)

FOREIGN PATENT DOCUMENTS

CN 103636079 A 3/2014
CN 103703632 A 4/2014
(Continued)

OTHER PUBLICATIONS

Communication dated Nov. 20, 2018, issued by the China National Intellectual Property Administration in counterpart Chinese Application No. 201710800483.7.
(Continued)

*Primary Examiner* — Abdullah A Riyami
*Assistant Examiner* — Marcus E Harcum
(74) *Attorney, Agent, or Firm* — Sughrue Mion, PLLC

(57) ABSTRACT

A lever-type connector includes a housing and a lever. The lever is pivotally mounted on the housing, and is pivotally operable between a temporary locking position and a fitting completion position. The lever includes a pair of side plates and an operating portion. A lock portion is provided on the housing, and locks the lever positioned at the fitting completion position. The housing is configured to be fitted to a mating housing by rotating the lever from a fitting start position to the fitting completion position. The housing has a pair of walls that are provided at both sides of the lock portion. Arm protection walls are provided on upper edges of the pair of walls respectively with extending inward so as to cover both sides of the flexible arm portion of the lock portion.

10 Claims, 8 Drawing Sheets

(51) Int. Cl.
*H01R 13/502* (2006.01)
*H01R 107/00* (2006.01)

(58) Field of Classification Search
USPC ..... 439/157, 353
See application file for complete search history.

(56) References Cited

U.S. PATENT DOCUMENTS 6,439,902 B1* 8/2002 Cole ..... H01R 13/62938 439/157
2003/0054681 A1* 3/2003 Hatagishi ..... H01R 13/62933 439/157
2007/0020978 A1* 1/2007 Murakami ..... H01R 13/6295 439/157
2007/0026706 A1* 2/2007 Matsubara ..... H01R 13/62955 439/157
2007/0287310 A1* 12/2007 Dekoski ..... H01R 13/62938 439/157
2008/0102666 A1* 5/2008 Yamashita ..... H01R 13/62938 439/157
2009/0117770 A1* 5/2009 Fukui ..... H01R 13/4364 439/345
2013/0230994 A1* 9/2013 Kamiya ..... H01R 13/62955 439/157
2013/0337677 A1* 12/2013 Puckett ..... H01R 43/027 439/357
2014/0106600 A1 4/2014 Shimizu et al.
2014/0178121 A1* 6/2014 Kamiya ..... H01R 13/62955 403/33
2014/0248788 A1 9/2014 Kodama et al.
2014/0256169 A1* 9/2014 Suzuki ..... H01R 13/62955 439/312
2019/0081419 A1* 3/2019 Hsieh ..... H01R 35/02

FOREIGN PATENT DOCUMENTS

CN 103918139 A 7/2014
CN 104067457 A 9/2014
CN 204304201 U 4/2015
JP 2005-293989 A 10/2005
JP 2007-35593 A 2/2007
JP 2008-166046 A 7/2008
JP 2011-60671 A 3/2011
JP 201269415 A 4/2012
JP 2012-89302 A 5/2012
JP 2013-26154 A 2/2013
JP 2016-18636 A 2/2016

OTHER PUBLICATIONS

Communication dated Nov. 13, 2018, issued by the Japanese Patent Office in counterpart Japanese Application No. 2016-174968.
Communication dated Apr. 16, 2019, issued by the Japanese Patent Office in counterpart Japanese Application No. 2016-174968.
Communication dated May 8, 2019 issued by the State Intellectual Property Office of P.R. China in counterpart Chinese Application No. 201710800483.7.

* cited by examiner

LEVER-TYPE CONNECTOR

CROSS REFERENCE TO RELATED APPLICATIONS

This application is based on Japanese Patent Application (No. 2016-174968) filed on Sep. 7, 2016, the contents of which are incorporated herein by reference.

BACKGROUND OF THE INVENTION

1. Field of the Invention

The present invention relates to a lever-type connector.

2. Description of the Related Art

Conventionally, a lever-type connector is known that can perform a connector fitting with a low insertion force due to a rotational force by rotating a lever pivotally mounted on a housing so that the connector is fitted into a mating housing of a mating connector (see, for example, JP-A-2012-69415).

In this lever-type connector, the housing is fitted into the mating housing, and thereafter the lever is pivoted from a fitting start position to a fitting completion position, and by engaging and locking to a flexible arm portion of a lock portion of the housing, thereby the housing maintains a state that the connector is fitted to the mating housing.

Before fitting to a mating connector, for example, at the time of packing or transporting, electrical wires can get caught on the lock portion of a housing undesirably so that a flexible arm portion can get lifted up, or the flexible arm portion can be pushed strongly by an operator's fingers causing damage. Even after fitting the connector, and when a load is further applied after an attempt to excessively rotate the lever, a load is applied to the flexible arm portion and deformation of the flexible arm portion may occur. In this way, when the flexible arm of the lock portion is deformed or damaged and the lever cannot be reliably locked into the fitting completion position, the locking of the lever by the lock portion of the housing is off, and the reliability of fitting with the mating connector may be reduced.

SUMMARY OF THE INVENTION

The present invention has been made in view of the above circumstances, and its objective is to provide a lever-type connector capable of protecting the lock portion of a housing and achieving high reliability in fitting with a mating connector.

In order to achieve the above objective, the lever-type connector according to the present invention is characterized by (1) to (5) as follows:

(1) a lever-type connector, including:

a housing configured to be inserted and removed from a mating housing of a mating connector;

a lever, pivotally mounted on the housing, and that is pivotally operable between a temporary locking position and a fitting completion position of the lever, the lever including:

a pair of side plates arranged along surfaces on both sides of the housing; and an operating portion that connect ends of the side plates; and a lock portion, provided on the housing, and that locks the lever positioned at the fitting completion position, wherein the housing is configured to be fitted to the mating housing by rotating the lever from a fitting start position to the fitting completion position;

wherein the housing has a pair of walls, that are provided at both sides of the lock portion for locking the operating portion of the lever; and wherein arm protection walls are provided on upper edges of the pair of walls respectively with extending inward so as to cover both sides of the flexible arm portion of the lock portion.

(2) The lever-type connector according to (1), wherein the operating portion is disposed above the arm protection wall when the lever is positioned at the fitting completion position.

(3) The lever-type connector according to (1) or (2), wherein the arm protection walls extend in parallel with an upper surface of the housing so as to close to each other.

(4) The lever-type connector according to any one of (1) to (3), wherein recess portions that externally fit the pair of walls are formed on the operating portion;

wherein inner surfaces of the recessed portions contact outer surfaces of the pair of walls facing the inner surfaces respectively when the lever is positioned at the fitting completion position.

(5) The lever-type connector according to (4), wherein a backlash-eliminating protrusion is provided on either the inner surfaces of the recess portions or the outer surfaces of the pair of walls.

The lever-type connector of the above configuration can prevent the flexible arm portion from being deformed due to being undesirably pressed on before fitting the connector since the flexible arm portion of the lock portion is surrounded by the pair of the walls and the arm protection walls extending from these walls.

Furthermore, since the arm protection walls are extended so as to cover the flexible arm portion and, thereby, overlap upper portions of both sides of the flexible arm portion, in the event that the flexible arm portion is undesirably lifted up, deformation of the flexible arm portion can be prevented by bringing the two sides in contact with the arm protection walls.

In the lever-type connector of the above configuration, since the operating portion of the lever moved to the fitting completion position is disposed on the arm protection walls, even when a further load is applied in an effort to excessively rotate the lever after fitting the connector, no load will be applied to the flexible arm portion protected by the arm protection walls and deformation of the flexible arm portion can be prevented.

In the lever-type connector having the configuration described above in (3), when the lever is moved to the fitting completion position, the recessed portions of the operating portion are externally fitted to the pair of the walls on both sides of the lock portion without any gaps (a state of no gaps or pressurized contact). Therefore, it is possible to suppress backlash of the operating portion of the lever engaged and locked to the flexible arm portion of the lock portion in the fitting completion position. As a result, even if an external force such as vibration or shock is applied, the lever can be engaged and locked by the flexible arm portion, thus high fitting reliability with the mating connector can be achieved.

In the lever-type connector of the above configuration, when the lever is placed in the fitting completion position, the backlash-eliminating protrusions protruding from either the outer surfaces of the pair of walls or the inner surfaces of the recessed portions are compressed and deformed in a state where the recessed portions of the operating portion are pressed against the pair of walls. By backlash-eliminating protrusions which are easy to compress and deform, it is possible to easily suppress backlash of the operating portion of the lever engaged and locked to the lock portion in the fitting completion position.

According to the present invention, it is possible to provide a lever-type connector that protects a lock portion of a housing and obtains a high fitting reliability with a mating connector.

The present invention has been briefly described above. Furthermore, details of the present invention will be further clarified by reading about the forms for carrying out the invention (hereinafter referred to as "embodiments") described below with reference to the attached drawings.

BRIEF DESCRIPTION OF THE DRAWINGS

FIGS. 4A and 4B are enlarged views illustrating a main portion showing a side plate of the lever pivotally supported by a support shaft of the housing, in which FIG. 4A shows a state where the lever is in a temporary locking position, and FIG. 4B shows a state where the lever is in the fitting completion position.

FIGS. 7A and 7B are explanation views that describe the movement of a locking protrusion and a cam boss in accordance with the rotation of the lever, wherein FIG. 7A shows a state before the housing is fitted to the mating connector, and FIG. 7B shows a state in which the housing is fitted in the mating connector and the cam boss is in contact with the cam groove.

FIGS. 8A and 8B are views that describe the movement of the locking protrusion and the cam boss in accordance with the rotation of the lever, wherein FIG. 8A shows a state in which the housing is pushed into the mating connector and the lever is moved from the temporary locking position to the fitting start position, and FIG. 8B shows a state in which the lever has been moved to the fitting completion position.

DETAILED DESCRIPTION OF THE EXEMPLARY EMBODIMENTS

Hereinafter, an embodiment of the present invention will be described with reference to the drawings.

Figure 1A:
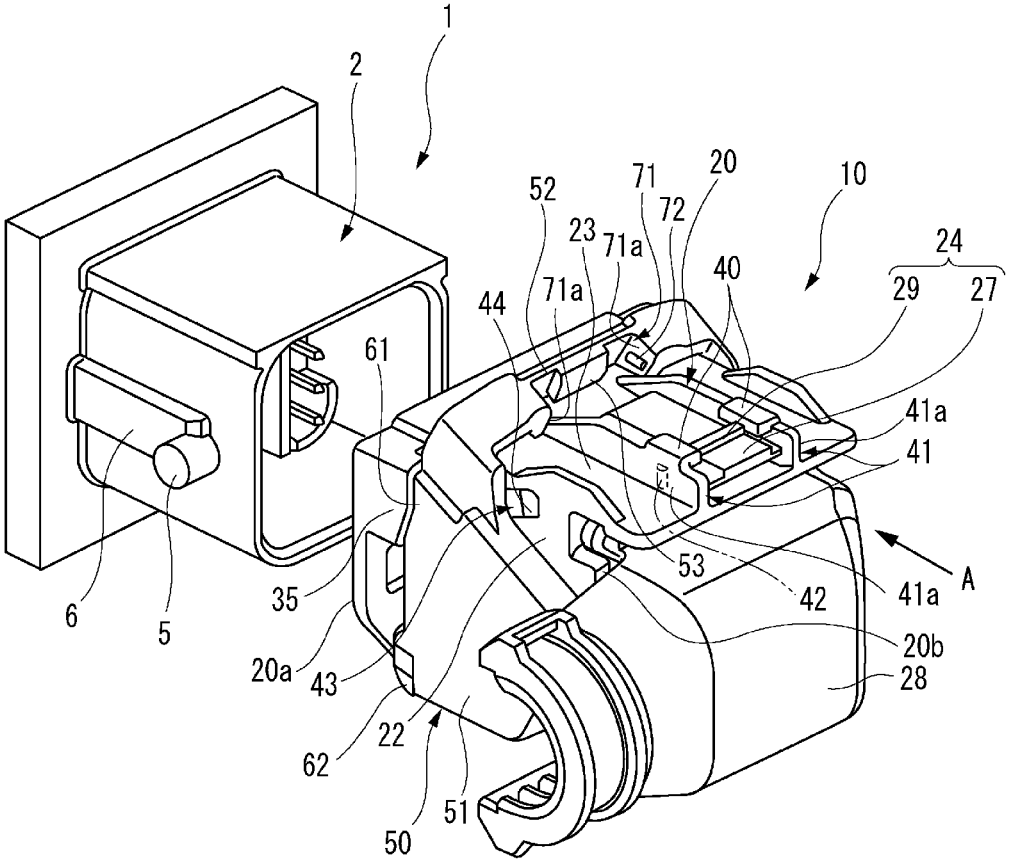
FIG. 1A is a perspective view illustrating a lever-type connector according to an embodiment of the present invention before being fitted to a mating connector viewed from a rear side.
Figure 1B:
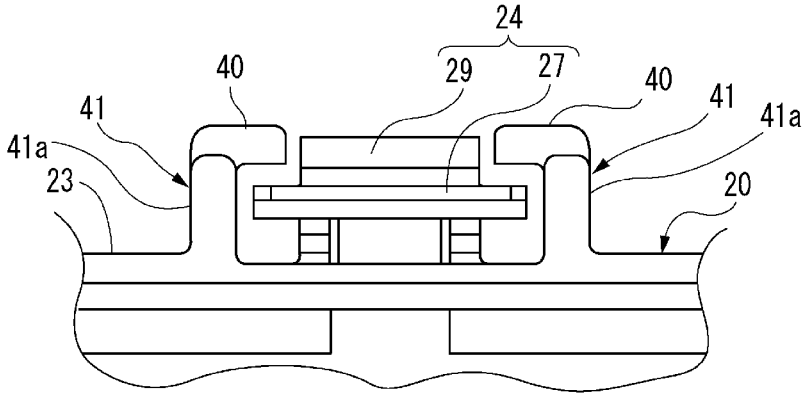
FIG. 1B is an enlarged view thereof viewed in a direction of arrow A in FIG. 1A.
Figure 2:
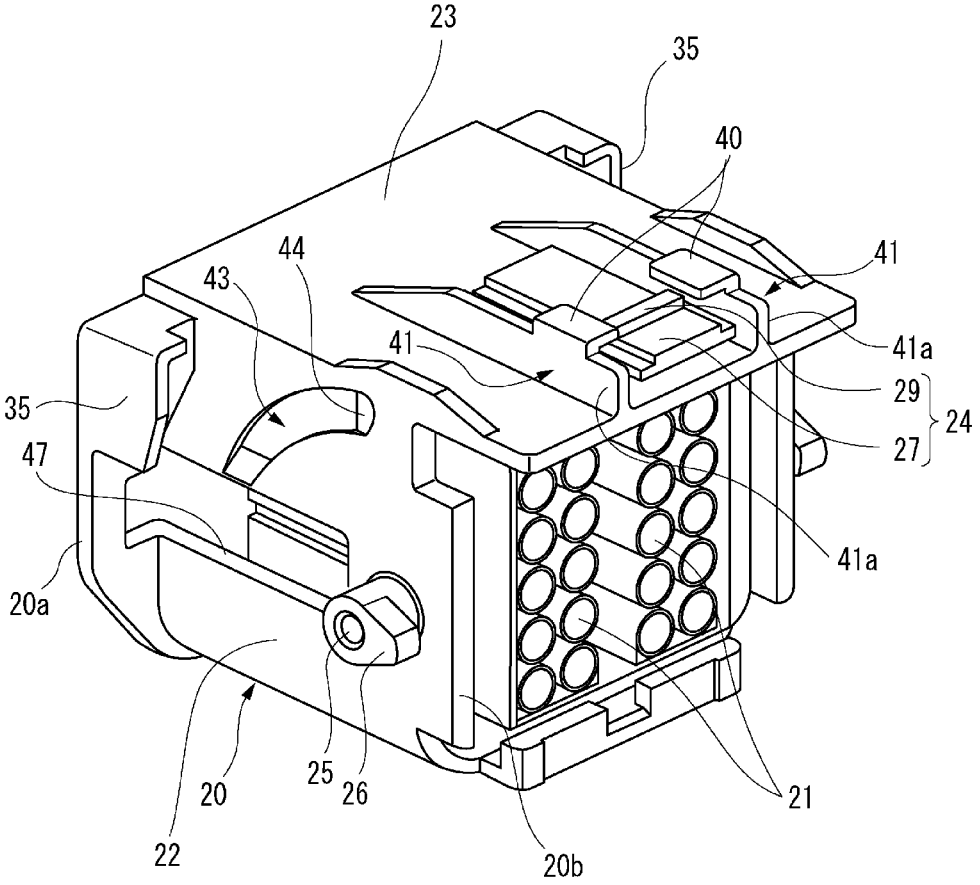
FIG. 2 is a perspective view illustrating the housing shown in FIG. 1.
Figure 3A:
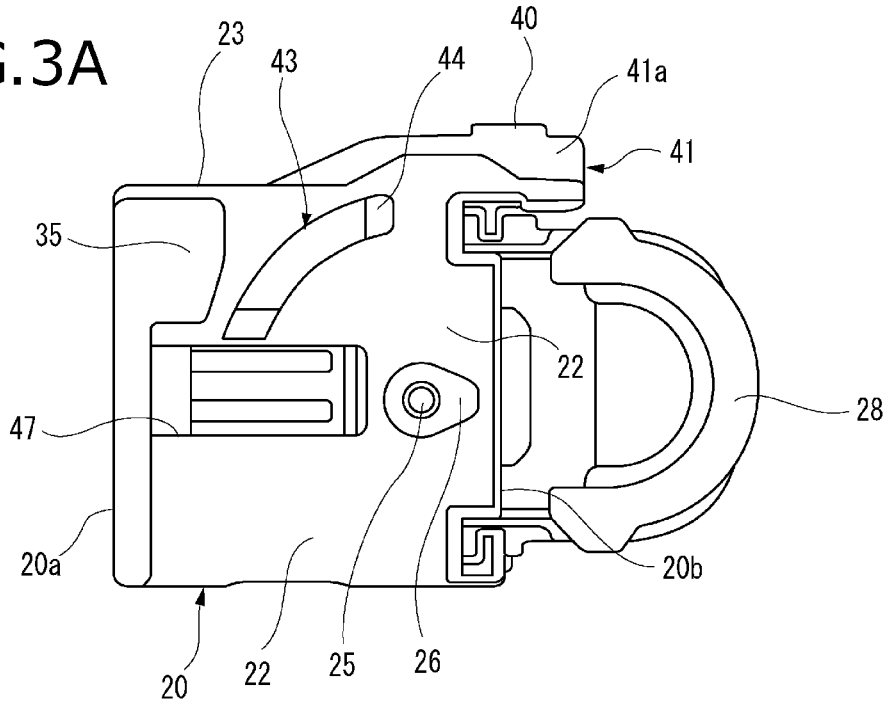
FIG. 3A is a side view of the housing shown in FIG. 2.
Figure 3B:
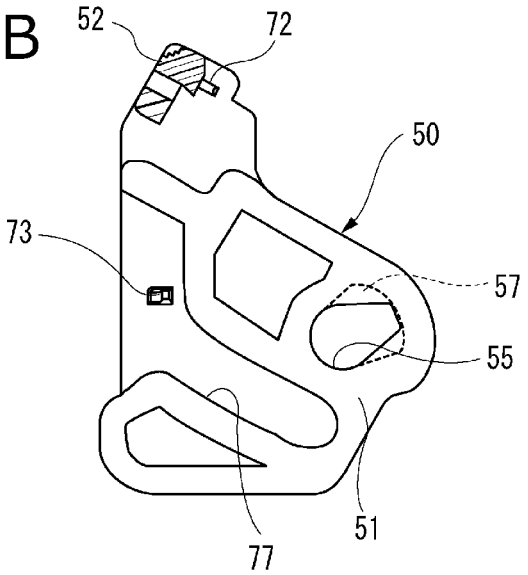
FIG. 3B is a cross sectional view illustrating an inner surface of the side plate of the lever shown in FIG. 1.

FIG. 1A is a perspective view illustrating a lever-type connector 10 according to an embodiment of the present invention before being fitted to a mating connector 1 as viewed from a rear, and FIG. 1B is an enlarged view thereof viewed in a direction of arrow A in FIG. 1A. FIG. 2 is a perspective view illustrating the housing 20 shown in FIG. 1. FIG. 3A is a side view of the housing 20 shown in FIG. 2, and FIG. 3B is a cross sectional view illustrating an inner surface of the side plate of the lever shown in FIG. 1.

As illustrated in FIGS. 1A to 3B, the lever-type connector 10 according to the present embodiment includes a housing 20 and a lever 50. The lever-type connector 10 is fitted to the mating connector 1 by fitting the mating housing 2 and the housing 20 to each other. The lever 50 has a pair of side plates 51 arranged along surfaces of both sides 22 of the housing 20 and an operating portion 52 connecting the ends of the side plates 51. The lever 50 is rotatable around an axis in the horizontal direction with respect to the housing 20.

Figure 6A:
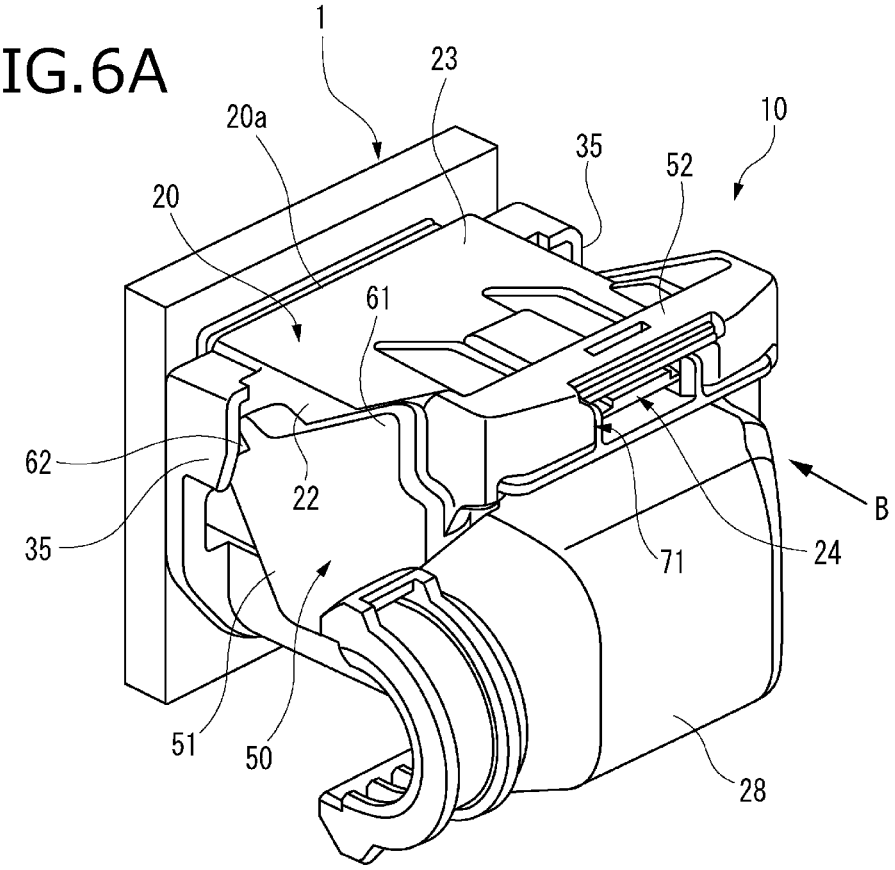
FIG. 6A is a perspective view illustrating the lever-type connector shown in FIG. 5 with the lever moved to and positioned at the fitting completion position.

The lever 50 is rotated between a temporary locking position (see FIG. 1A) and a fitting completion position (see FIG. 6A). The housing 20 has a lock portion 24 for locking the operating portion 52 of the lever 50 on the upper surface 23 of the housing 20. The lever 50 locks into the fitting completion position by the lock portion 24 when the operating portion 52 is engaged and locked to the lock portion 24. The lever-type connector 10 is assisted in fitting to and detaching from the mating connector 1 by rotation of the lever 50. That is, the lever-type connector 10 is an LIF (Low Insertion Force) connector that is fitted to the mating connector 1 with a low insertion force by operation of the lever 50.

The housing 20 is made of insulating synthetic resin, and a front part 20*a* of the housing 20 is fitted to the mating housing 2 of the mating connector 1. The housing 20 has a plurality of terminal accommodating chambers 21. These terminal accommodating chambers 21 are formed along a direction of fitting with the mating connector 1, and terminals (not shown) connected to electrical wires (not shown) are accommodated in the respective terminal accommodating chambers 21. Electrical wires connected to terminals accommodated in the terminal accommodating chambers 21 are pulled out from a rear part 20*b* of the housing 20. An electrical wire cover 28 is attached to the rear part 20*b* of the housing 20, and the electrical wires pulled out from the rear part 20*b* of the housing 20 are covered with the electrical wire cover 28 and are bundled and pulled out in one direction (lateral direction in this example). By fitting the lever-type connector 10 into mating connector 1, terminals accommodated in the terminal accommodating chambers 21 of the housing 20 are electrically connected to the terminals provided in the mating housing 2 of the mating connector 1.

As shown in FIGS. 2 and 3A, support shafts 25 protrude from the surfaces of both sides 22 of the housing 20. The lever 50 has a pivot hole 55 in respective one of its side plates 51, and the support shafts 25 of the housing 20 are respectively inserted through the pivot holes 55. As a result, the lever 50 is rotatable about the support shafts 25 inserted through the pivot holes 55 of the side plates 51. A locking piece 26 that extends rearward of the housing 20 with intersecting the support shaft axis is formed at the tip of each of the support shafts 25.

In each of the side plates 51, the pivot hole 55 has a shape corresponding to the outer shape of the locking piece 26, so the locking piece 26 can only be inserted through each of the side plates 51 when the lever 50 is disposed between the temporary locking position and fitting completion stop position and the locking piece 26 is aligned with the shape of the pivot hole 55. The locking piece 26 inserted into the pivot hole 55 prevents the side plate 51 from coming off, when the locking piece 26 is in a range corresponding to a locking recess portion 57 that is formed in the outer surface of the side plate 51.

Furthermore, on the bottom surface of the locking recess portion 57 in the vicinity of the pivot hole 55, a pressed protrusion 56 is formed. The side plate 51 is moved toward the side surface 22 by the pressed protrusion 56 that is pressed by the inner surface of the locking piece 26 when the lever 50 is moved to the fitting completion locking position.

Figure 4A:
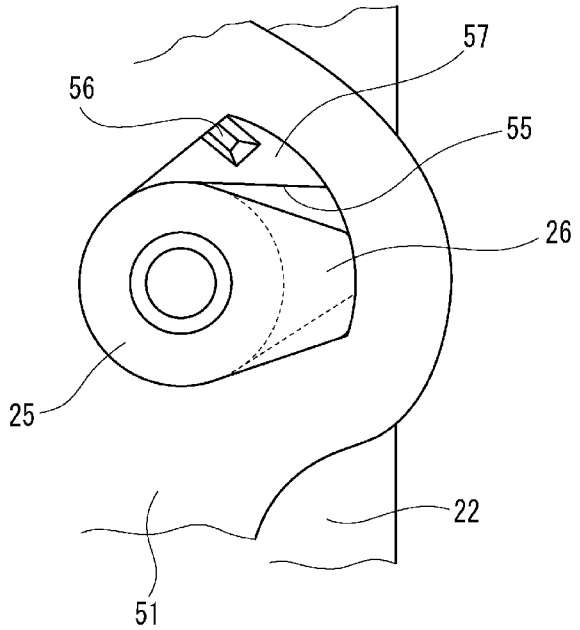
Figure 4B:
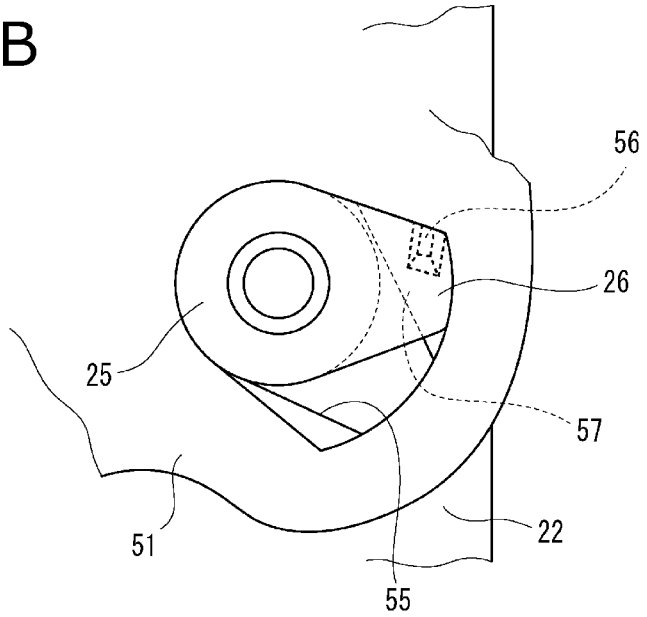
Figure 5:
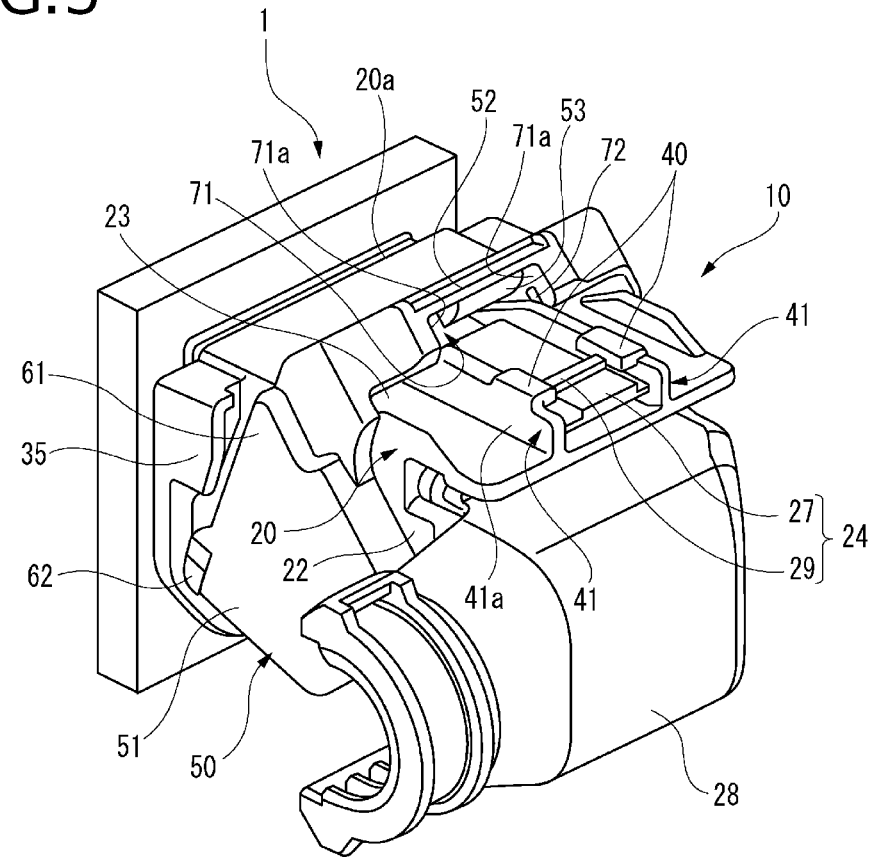
FIG. 5 is a perspective view illustrating the lever-type connector shown in FIG. 1 in a state where the housing is fitted in the mating housing and the lever has moved to and positioned at a fitting start position.

As shown in FIG. 4A, when the lever 50 is in the temporary locking position, the locking piece 26 of the support shaft 25 overlaps a part of the locking recess portion 57. As a result, in a state in which the lever 50 is disposed at the temporary locking position, the locking recess portion 57 is locked to the locking piece 26. Also, as shown in FIG. 4B, even when the lever 50 is disposed at the fitting completion position, the locking piece 26 of the support shaft 25 overlaps a part of the locking recess portion 57. As a result, in a state where the lever 50 is disposed at the fitting completion position, the locking recess portion 57 is locked to the locking piece 26.

As shown in FIG. 3A, guide grooves 47 are formed on both sides 22 of the housing 20 and open up toward the front part 20*a*. The guide grooves 47 are formed along the front-rear direction of the housing 20. When the housing 20 is fitted to the mating housing 2, the cam bosses 5 and the guide protrusions 6 (see FIG. 1A) on both side surfaces of the mating housing 2 are inserted in the guide grooves 47.

As shown in FIG. 3B, a cam groove 77 is formed on the inner surface of the side plate 51 of the lever 50 facing the side surface 22 of the housing 20. The cam groove 77 is open on the front side of the lever 50 in a state of being moved to the temporary locking position and extends obliquely downward toward the rear side of the lever 50. When the housing 20 is fitted to the mating housing 2, the cam bosses 5 of the mating housing 2 enter the cam grooves 77 (see FIG. 7B). Then, when the lever 50 is rotated from this state toward the fitting completion position, the cam groove 77 of the lever 50 rotates, and the cam boss 5 entering the cam groove 77 is retracted in the cam groove 77 (refer to FIGS. 8A and 8B). As a result, the housing 20 and the mating housing 2 are drawn to each other and fitted together.

On the inner surface of the side plate 51 of the lever 50, a locking protrusion 73 is formed for locking the lever 50 to the temporary locking position with respect to the housing 20. When the lever 50 is moved to the temporary locking position, the locking protrusion 73 is disposed in the guide groove 47 and is locked to the upper-edge portion of the guide groove 47 (see FIG. 7A).

On both sides 22 of the housing 20, there are escape grooves 43 in which the locking protrusions 73 are in a non-contact state when the lever 50 rotates. The escape groove 43 is formed in an arc shape with the support shaft 25 as its center. On one end (the upper end in FIG. 3A) of the escape groove 43, a final locking surface 44 is formed. The final locking surface 44 is a tapered surface that gradually becomes shallower toward the upper end portion of the escape groove 43.

When the lever 50 is rotated toward the fitting completion position, the locking protrusion 73 goes over the upper-edge portion of the guide groove 47, is guided into the escape groove 43, and moves through the escape groove 43. When the lever 50 is rotated, by way of the locking protrusion 73 on the inner surface of the side plate 51 of the lever 50 moving through the escape groove 43 on the side surface 22 of the housing 20, the lever 50 smoothly rotates in a predetermined direction without the locking protrusion 73 coming into contact with the side surface 22 of the housing 20.

Figure 8A:
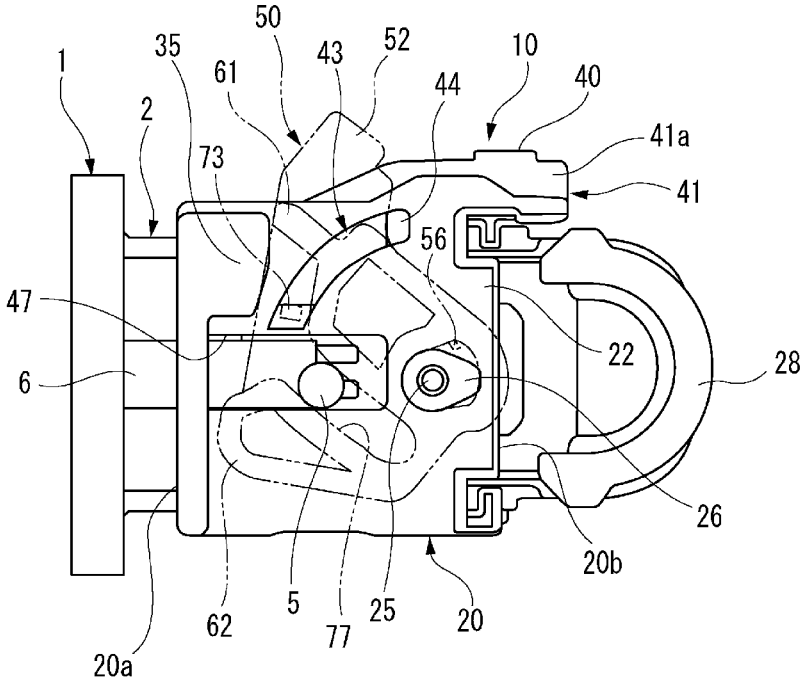
Figure 8B:
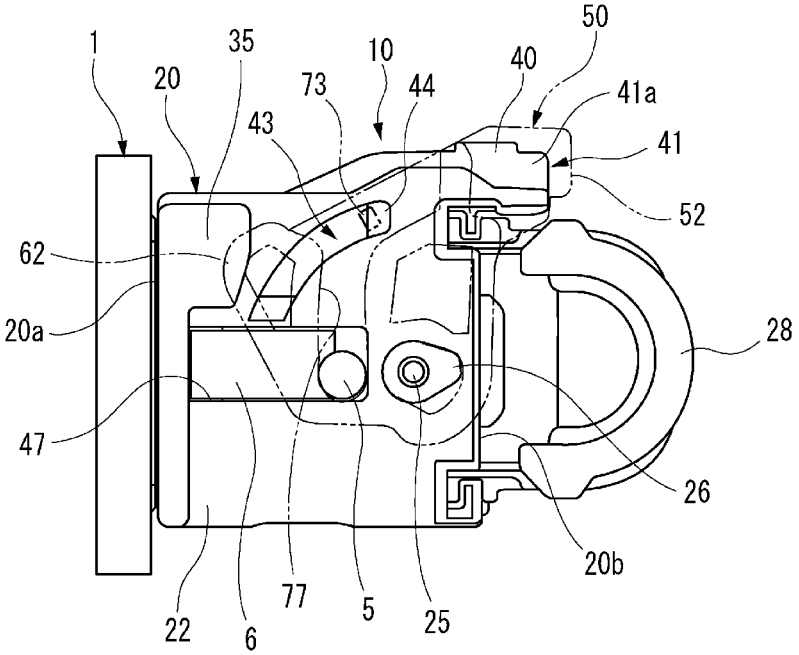

When the lever 50 reaches the fitting completion stop position, the locking protrusion 73 of the lever 50 rides on the final locking surface 44 having a tapered surface and suppresses backlash of the lever 50 (see FIG. 8B).

As shown in FIGS. 1A, 1B and 2, the housing 20 has a lever-disengagement prevention portion 35. The lever-disengagement prevention portion 35 is provided at the upper position on both sides of the housing 20, and is formed so as to extend rearward along both sides 22 from the front part 20*a*. The lever 50 has an upper-edge portion 61 and a vibration-suppressing protrusion 62 on a part of the side plate 51.

In a state where the lever 50 is moved to the temporary locking position, the upper-edge portion 61 of the side plate 51 facing the lever-disengagement prevention portion 35 goes inside the lever-disengagement prevention portion 35 (see FIG. 1). By way of the lever 50 moving to the temporary locking position, the upper-edge portion 61 is covered from the outside by the lever-disengagement prevention portion 35, and the side plate 51 is prevented from being detached from the housing 20.

In a state where the lever 50 is moved to the fitting completion position, the vibration-suppressing protrusion 62 goes inside the lever disengagement prevention portion 35 (see FIG. 6). When the lever 50 is moved to the fitting completion position, the vibration-suppressing protrusion 62 of the side plate 51 is covered from the outside by the lever-disengagement prevention part 35 and the inner surface of the lever-disengagement prevention part 35 is pressed against the vibration-suppressing protrusion 62 thereby eliminating backlash of the side plate 51 with respect to the lever-disengagement prevention portion 35. It is sufficient if the inner surface of the lever-disengagement prevention portion 35 is in contact with the vibration-suppression protrusion 62. An inner face of the lever-disengagement prevention portion 35 need not be pressurized by the vibration-suppressing protrusion 62 as long as they are in a state in which there are no gaps.

As shown in FIGS. 1A to 2, the lock portion 24 provided on the upper surface 23 of the housing 20 has a flexible arm portion 27 and an engaging portion 29. When the lever 50 is moved to the fitting completion position, the engaging portion 29 locks the lock portion 53 protruding from the operating portion 52. As a result, the lock portion 53 of the lever 50 is locked to the engaging portion 29 of the lock portion 24 so that rotation of the lever 50 is restricted with respect to the housing 20, which is so called as a locked state.

A pair of walls 41 stand upright on the upper surface 23 of the housing 20 and are arranged on both sides of the lock portion 24 for locking the operating portion 52. Further, on the upper edges of the walls 41, arm protection walls 40 extend inward so as to cover both sides of the flexible arm portion 27. Accordingly, since the lock portion 24 is surrounded by the pair of walls 41 and the arm protection wall 40, the flexible arm portion 27 is prevented from deformation due to being undesirably pressed on before fitting the connector.

For example, during packing before fitting to the mating connector 1 or during transportation, it is difficult for electrical wires to be caught by the flexible arm portion 27 surrounded by the pair of walls 41 and arm protection wall 40, and the flexible arm portion 27 can not be lifted up by any electrical wire that gets caught.

Further, as shown in FIG. 1B, since the arm protection walls 40 are extended so as to overlap upper portions of both sides of the flexible arm portion 27, even in the event that the flexible arm portion 27 is undesirably lifted up, the arm protection walls 40 will come into contact with both sides of the flexible arm portion 27 and restrict the upward deformation of the flexible arm portion 27, thereby, preventing deformation of the flexible arm portion 27.

Next, a case where the lever-type connector 10 is fitted to the mating connector 1 will be described.

FIGS. 7A to 8B are views for describing the movement of the locking projection 73 and cam boss 5 in accordance with the rotation of the lever 50.

Figure 7A:
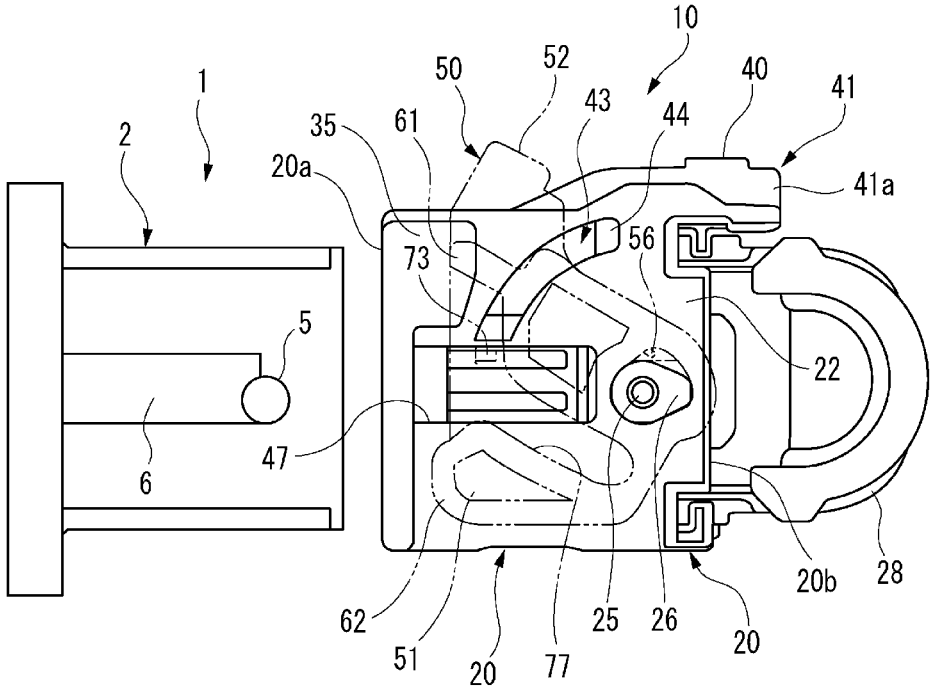

As shown in FIG. 7A, the housing 20 of the lever-type connector 10 in a state where the lever 50 is temporarily engaged in the temporary locking position is fitted to the mating housing 2 of the mating connector 1.

Here, the operator places the thumb against the vicinity of the rear edge of the upper surface 23 and pushes the housing 20 into the mating housing 2 (see FIG. 1A). With the flexible arm portion 27 of the lock portion 24 being surrounded by the pair of walls 41 and the arm protection wall 40, any pushing force on the housing 20 is applied to the pair of walls 41 and the arm protection wall 40, without being applied to the flexible arm portion 27. Accordingly, the flexible arm portion 27 is prevented from being undesirably pressed and deformed.

Figure 7B:
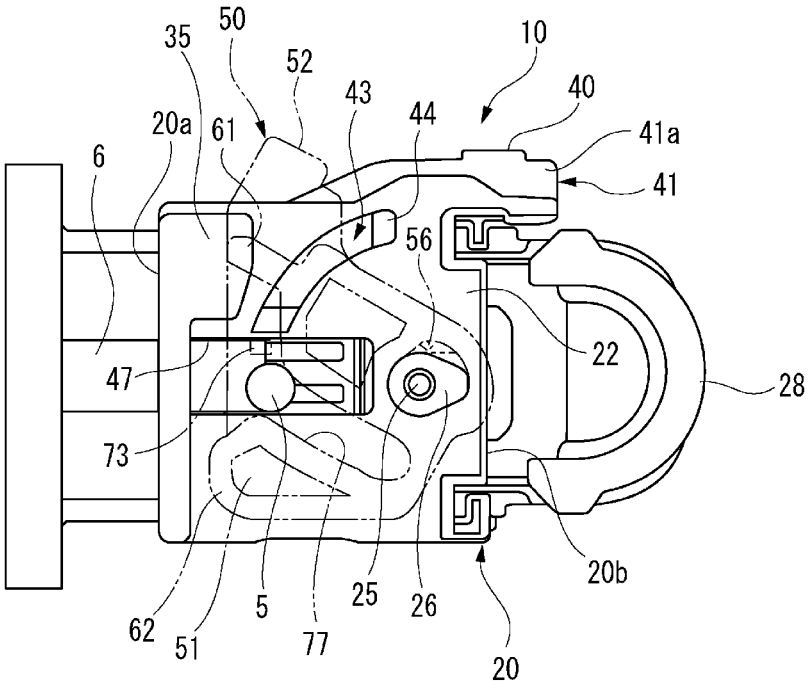

Next, as shown in FIG. 7B, when the housing 20 is fitted to the mating housing 2 and the cam bosses 5 and the guide protrusions 6 of the mating housing 2 are inserted into the guide grooves 47 of the housing 20, each of the cam bosses 5 abuts on respective one of the cam grooves 77 of the lever 50. When the housing 20 is pushed into the mating housing 2, each of the cam bosses 5 of the mating housing 2 is pushed into the respective one of the cam grooves 77 of the lever 50, and the lever 50 is rotated toward the fitting start position by the pushing force. From this, each of the locking protrusions 73 of the side plates 51 of the lever 50 is released from engagement with respective one of the upper edge portions of the guide grooves 47 and enters corresponding one of the escape grooves 43.

Then, as shown in FIG. 8A, the lever 50 temporarily engaged in the temporary locking position is moved to the fitting start position. In this state, the operating portion 52 of the lever 50 is held by the operator and the lever 50 is rotated to the fitting completion position. At this point, the operator can shift the thumb, which is in the vicinity of the rear edge of the upper surface 23, to the operating portion 52 of the lever 50, and rotates the lever 50 without having to change the housing 20. In this way, good operability is achieved.

When the lever 50 is rotated to the fitting completion position, each of the cam bosses 5 of the mating housing 2 is retracted into the respective one of the cam grooves 77 of the lever 50, and as shown in FIG. 8B, the housing 20 and the mating housing 2 are fitted to each other, the lever-type connector 10 is fitted to the mating connector 1, and the terminals are electrically connected.

When the lever 50 is moved to the fitting completion position, the lock portion 53 of the operation portion 52 is engaged and locked to the engaging portion 29 of the lock portion 24, and the rotation of the lever 50 relative to the housing 20 is restricted in the locked state.

Figure 6B:
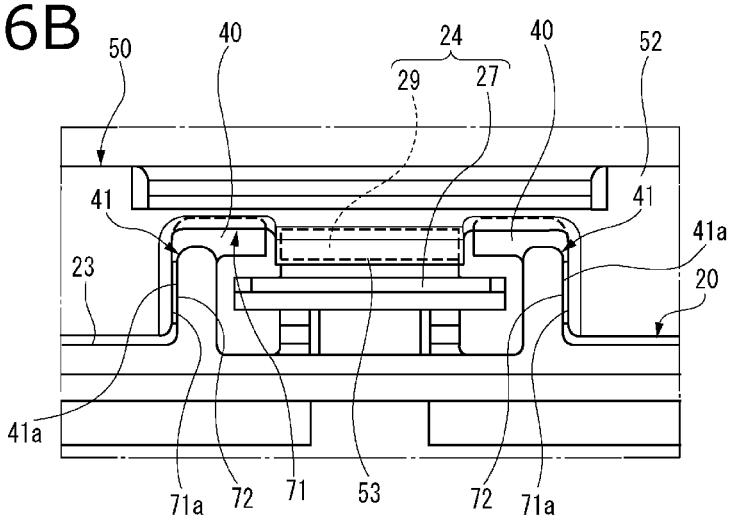
FIG. 6B is an enlarged view thereof viewed in the direction of arrow B in FIG. 6A.

As shown in FIG. 6B, in the lever-type connector 10 of the present embodiment, the operating portion 52 of the lever 50 moved to the fitting completion position is disposed above the arm protection wall 40. Therefore, even when a further load is applied in an effort to excessively rotate the lever 50 after fitting the connector, no load will be applied to the flexible arm portion 27 protected by the pair of walls 41 and arm protection wall 40 and deformation of the flexible arm portion 27 can be prevented.

Furthermore, there are recessed portions 71 which can externally fit the pair of walls 41 in the operating portion 52 of the lever 50. When the lever 50 is moved to the fitting completion position, the inner surfaces 71*a* of the recessed portions 71 contact the opposing outer surfaces 41*a* of the pair of walls 41, respectively. That is, the recessed portions 71 of the operating portion 52 are externally fitted to the pair of walls 41 without gaps (a state of no gaps or pressurized contact). With backlash-eliminating protrusions 72 protruding inward and being provided on the inner surfaces 71*a* of the recessed portions 71 of the present embodiment, the backlash-eliminating protrusions 72 are compressed and deformed and the recessed portions 71 of the operating portion 52 are brought into pressurized contact with the pair of walls 41 (see FIG. 1A and FIG. 6B). As shown by the dashed line in FIG. 1A, backlash-eliminating protrusions 42 protruding outward can also be provided on the outer surfaces 41*a* of the pair of walls facing the inner surfaces 71*a* of the recessed portions 71.

Therefore, backlash of the operating portion 52 of the lever 50 that is engaged and locked to the lock portion 24 in the fitting completion position can be further suppressed. As a result, even if an external force such as vibration or shock is applied, the lever 50 can be engaged and locked by the lock portion 24, thus high fitting reliability with the mating connector 1 can be achieved.

When the lever 50 is moved to the fitting completion position, the vibration-suppressing protrusion 62 of the side plate 51 enters the inside of the lever-disengagement prevention portion 35. Consequently, the vibration-suppressing protrusion 62 of the side plate 51 is covered from the outside by the lever-disengagement prevention portion 35 and the inner surface of the lever disengagement prevention portion 35 is brought into pressurized contact with the vibration-suppressing protrusion 62. As a result, backlash of the side plate 51 with respect to the lever-disengagement prevention portion 35 of the lever 50 is suppressed.

Further, when the lever 50 is rotated to the fitting completion position, the locking protrusion 73 protruding from the inner surface of each of the side plate 51 passes through the corresponding one of the escape grooves 43 and rides on the corresponding final locking surface 44 having the tapered surface. As a result, backlash of the side plate 51 with respect to the side surface 22 of the housing 20 is suppressed in the lever 50.

When the lever 50 is then rotated to the fitting completion position, the pressed protrusion 56 projecting from the outer surface of the side plate 51 is pressed toward the side surface 22 by the inner surface of the locking piece 26 of the support shaft 25. The backlash of the side plate 51 with respect to the support shaft 25 of the housing 20 is suppressed in the lever 50.

In this way, in the lever-type connector 10 of the present embodiment, the operating portion 52 of the lever 50 is held and the lever 50 is rotated by the operator, thereby the insertion force of the housing 20 applied to the mating housing 2 is assisted through the cam mechanism constituted by the cam groove 77 and cam boss 5.

As described above, in the lever-type connector 10 according to the present embodiment, when the housing 20 is fitted into the mating housing 2 and the lever 50 at the fitting start position is rotated and moved to the fitting completion position, the housing 20 is fitted to the mating housing 2 and the lever 50 is engaged and locked to the lock portion 24. Since the flexible arm portion 27 of the lock portion 24 is surrounded by the pair of walls 41 and the arm protection walls 40 extending to the walls 41, it is prevented from deformation due to being undesirably pressed on before fitting the connector.

Furthermore, since the arm protection walls 40 are extended so as to cover and, thereby, overlap upper portions of both sides of the flexible arm portion 27, in the event that the flexible arm portion 27 is undesirably lifted up, deformation of the flexible arm portion 27 can be prevented by bringing the two sides in contact with the arm protection walls 40.

Since the vibration suppressing protrusions 62, which are a part of the side plates 51 of the lever 50, are covered from the outside by the lever-disengagement prevention portions 35 provided on both sides of the housing 20, disengagement of the side plate 51 from the housing 20 is prevented in the lever 50 that is engaged and locked to the lock portion 24 in the fitting completion position. As a result, even if an external force such as vibration or shock is applied to the lever 50, the lever 50 can be engaged and locked by the lock portion 24, thus high fitting reliability with the mating connector 1 can be achieved.

When the lever 50 is moved to the fitting completion position, the inner surface of the lever-disengagement prevention portion 35 is pressed against the vibration suppressing protrusions 62 provided on the side plate 51 of the lever 50. The lever 50, in which the side plates 51 do not rattle with respect to the lever disengagement prevention portion 35, does not generate abnormal noise even when vibrations are applied.

Moreover, when the lever 50 is moved to the fitting completion position, the recessed portions 71 of the lever 50 are externally fitted to the walls 41 on both sides of the lock portion 24 without any gaps. Therefore, backlash of the operating portion 52 of the lever 50 that is engaged and locked to the lock portion 24 in the fitting completion position can be further suppressed. As a result, even if an external force such as vibration or shock is applied, the lever 50 can be engaged and locked by the lock portion 24, thus high fitting reliability with the mating connector 1 can be achieved. Furthermore, there are backlash-eliminating protrusions 72 projected from the inner surfaces 71*a* of the recessed portions 71. When the lever 50 is placed in the fitting completion position, the backlash-eliminating protrusions 72 protruding from the inner surfaces 71*a* of the recessed portions 71 are compressed and deformed in a state where the recessed portions 71 of the operating portion 52 are pressed against the pair of walls 41. Therefore, with the simple backlash-eliminating protrusions 72 that are easily compressed and deformed, backlash of the operating portion 52 of the lever 50 that is engaged and locked to the lock portion 24 in the fitting completion position can be easily suppressed.

Furthermore, in the lever-type connector 10 according to the present embodiment, the locking protrusions 73 on the inner surfaces of the side plates 51 of the lever 50 can lock the lever 50 to the housing 20 in the temporary locking position. Therefore, it is possible to prevent careless rotation of the lever 50 before fitting to the mating connector 1 and eliminate complicated operations in returning the carelessly rotated lever 50 to the temporary locking position, thus, making it possible to smoothly perform the fitting to the mating connector 1.

When rotating the lever 50, by way of the locking projection 73 on the inner surface of the side plate 51 of the lever 50 passing through the escape groove 43 formed in the side surface 22 of the housing 20, the lever 50 is smoothly pivoted in a predetermined direction without the locking protrusion 73 coming in contact with the side surface 22 of the housing 20. Then, when the lever 50 is moved to the fitting completion position, the locking protrusion 73 of the lever 50 rides on the locking surface 44 of the escape groove 43 and suppresses backlash of the lever 50. As a result, even if an external force such as vibration or shock is applied, the lever 50 can be engaged and locked by the lock portion 24 more securely, thus high fitting reliability with the mating connector 1 can be achieved.

Further, when the lever 50 is moved to the fitting completion position, the inner surface of the locking piece 26 of the support shaft 25, projecting from both sides 22 of the housing 20, presses the pressed protrusion 56, protruding from the bottom surface of the locking recess portion 57 formed in the vicinity of the pivot hole 55 in the side plate 51 of the lever 50, against the side surface 22. Therefore, in the side plates 51 of the lever 50, backlash of the support shaft 25 of the housing 20 is suppressed, and generation of noise from vibrations are prevented.

Since the locking protrusion 73 of the lever 50 is disposed inside the escape groove 43 when the lever 50 is in the middle of a rotation, the locking projection 73 does not receive the counter force from the side surface 22 of the housing 20. Therefore, the side plate 51 cannot float away. Also, when the opening of the pivot hole 55 in the middle rotation of the lever 50 overlaps and is aligned with the locking piece 26 of the support shaft 25, it is not possible for the support shaft 25 to come out of the pivot hole 55.

The present invention is not limited to the embodiment described above, and suitable modifications, improvements and so on can be made. Furthermore, the material, shape, dimensions, number, disposition, etc. of each component in the above embodiment is not limited as long as it can achieve the present invention.

Here, characteristics of the embodiment of the lever-type connector according to the present invention described above will be briefly summarized below in [1] to [4].

[1] A lever-type connector (10), including:

a housing (20) configured to be inserted and removed with respect to a mating housing (2) of a mating connector (1);

a lever (50), pivotally mounted on the housing, and that is pivotally operable between a temporary locking position and a fitting completion position of the lever, the lever including:

a pair of side plates (51) arranged along surfaces on both sides (22) of the housing; and an operating portion (52) that connect ends of the side plates; and a lock portion (24) provided on the housing, and locks the lever positioned at the fitting completion position, wherein the housing is configured to be fitted to the mating housing by rotating the lever from a fitting start position to the fitting completion position; and wherein the housing has a pair of walls (41) that are provided at both sides of the lock portion for engaging and locking the operating portion of the lever; and wherein arm protection walls (40) are provided on upper edges of the pair of walls respectively with extending inward so as to cover both sides of the flexible arm portion (27) of the lock portion.

[2] The lever-type connector (10) according to the item [1], wherein the operating portion is disposed above the arm protection walls when the lever is positioned at the fitting completion position.

[3] The lever-type connector (10) according to items [1] or [2], wherein the arm protection walls (40) extend in parallel with an upper surface of the housing (20) so as to close to each other.

[4] The lever-type connector (10) according to any one of items [1] to [3], wherein recessed portions (71) that externally fit the pair of walls are formed on the operating portion; and wherein each of inner surfaces (71*a*) of the recessed portions contact corresponding one of the outer surfaces (41*a*) of the pair of walls which faces corresponding one of the inner surfaces (71*a*) when the lever is positioned at the fitting completion position.

[5] The lever-type connector (10) according to the item [4], wherein a backlash-eliminating protrusion (71, 42) is provided on either the inner surfaces (71*a*) of the recessed portion (71) or the outer surfaces (41*a*) of the pair of walls (41).

What is claimed is:

1. A lever-type connector comprising:

a housing configured to be inserted and removed from a mating housing of a mating connector;

a lever, pivotally mounted on the housing, and that is pivotally operable between a temporary locking position and a fitting completion position of the lever, the lever comprising:

a pair of side plates arranged along surfaces on both sides of the housing; and an operating portion that connects ends of the side plates;

a lock portion, provided on the housing, and that locks the lever positioned at the fitting completion position, the lock portion having a flexible arm portion, the flexible arm portion having at least one recessed edge extending in a longitudinal direction of the flexible arm portion; and a locking protrusion formed on at least one of the pair of side plates of the lever, wherein the housing is configured to be fitted to the mating housing by rotating the lever from a fitting start position to the fitting completion position;

wherein the housing has a pair of walls that are provided at both sides of the lock portion, the pair of walls protruding upward from an upper surface of the housing;

wherein at least one arm protection wall is provided on an upper edge of one wall of the pair of walls at a position spaced away from front and rear distal edges of the one wall of the pair of walls in the longitudinal direction, the at least one arm protection wall extending inward so as to cover the at least one recessed edge of the lock portion;

wherein the lock portion is configured to lock the operating portion of the lever at a space formed between the pair of walls;

wherein an escape groove is formed on at least one of the sides of the housing, wherein the locking protrusion is configured to move through the escape groove when the lever is pivotally operated between the temporary locking position and the fitting completion position; and wherein a final locking surface is formed on one end of the escape groove and is configured such that the locking protrusion in the escape groove rides on the final locking surface when the lever reaches the fitting completion position, the final locking surface having a tapered surface.

2. The lever-type connector according to claim 1, wherein the operating portion is disposed above the at least one arm protection wall when the lever is positioned at the fitting completion position.

3. The lever-type connector according to claim 1, wherein the at least one arm protection wall extends in parallel with the upper surface of the housing so as to be close to each other.

4. The lever-type connector according to claim 1, wherein recessed portions that externally fit the pair of walls are formed on the operating portion; and wherein inner surfaces of the recessed portions contact outer surfaces of the pair of walls facing the inner surfaces respectively when the lever is positioned at the fitting completion position.

5. The lever-type connector according to claim 4, wherein a backlash-eliminating protrusion is provided on either the inner surfaces of the recessed portions or the outer surfaces of the pair of walls.

6. The lever-type connector according to claim 4, wherein a backlash-eliminating protrusion is provided on either vertical surface of the inner surface of the recessed portions of the operating portion or the outer surface of a wall of the pair of walls of the housing.

7. The lever-type connector according to claim 1, wherein in a case in which the lock portion is lifted such that the at least one arm protection wall comes in contact with the at least one recessed edge of the lock portion, deformation of the lock portion is prevented.

8. The lever-type connector according to claim 1, wherein recessed portions that externally fit the pair of walls are formed on the operating portion;

wherein backlash-eliminating protrusions are provided on outer surfaces of the pair of walls respectively; and wherein inner surfaces of the recessed portions contact the backlash-eliminating protrusions on the outer surfaces of the pair of walls respectively when the lever is positioned at the fitting completion position.

9. The lever-type connector according to claim 1, wherein a height in a vertical direction of the one wall of the pair of walls at least in an immediate vicinity of the at least one arm protection wall on both end sides of the at least one arm protection wall in the longitudinal direction is constant.

10. The lever-type connector according to claim 9, wherein the height of the one wall of the pair of walls at least in the immediate vicinity of the at least one arm protection wall on the both end sides of the at least one arm protection wall in the longitudinal direction is the same.

* * * * *